United States Patent [19]

Anderson

[11] 4,213,308

[45] Jul. 22, 1980

[54] VORTEX GENERATOR FOR SEPARATING A GASEOUS AND LIQUID REFRIGERANT

[76] Inventor: J. Hilbert Anderson, 2422 S. Queen St., York, Pa. 17402

[21] Appl. No.: 950,570

[22] Filed: Oct. 12, 1978

[51] Int. Cl.[2] ..... F25B 41/00

[52] U.S. Cl. ..... 62/196 R; 62/500; 62/503

[58] Field of Search ..... 62/116, 500, 503, 196 R; 55/463

[56] References Cited

U.S. PATENT DOCUMENTS

| | | | |
|---|---|---|---|
| 2,512,869 | 6/1950 | McBroom | 62/500 |
| 2,953,906 | 9/1960 | Quick | 62/503 |
| 3,212,289 | 10/1965 | Bottum | 62/503 |
| 3,670,519 | 6/1972 | Newton | 62/116 |
| 4,111,005 | 9/1978 | Livesay | 62/503 |

*Primary Examiner*—Ronald C. Capossela
*Attorney, Agent, or Firm*—Kemon & Estabrook

[57] ABSTRACT

A refrigeration or liquid chilling system embodying a compressor, condenser and evaporator. The system has interposed therein, downstream from the evaporator, a vortex generating structure which utilizes the energy generated by the vortex to compress the vapor coming out of the evaporator prior to discharging it to the inlet of the compressor. This arrangement tends to improve the efficiency of a liquid chilling system or, alternatively, to reduce the cost per unit of refrigeration produced.

8 Claims, 2 Drawing Figures

FIG 1
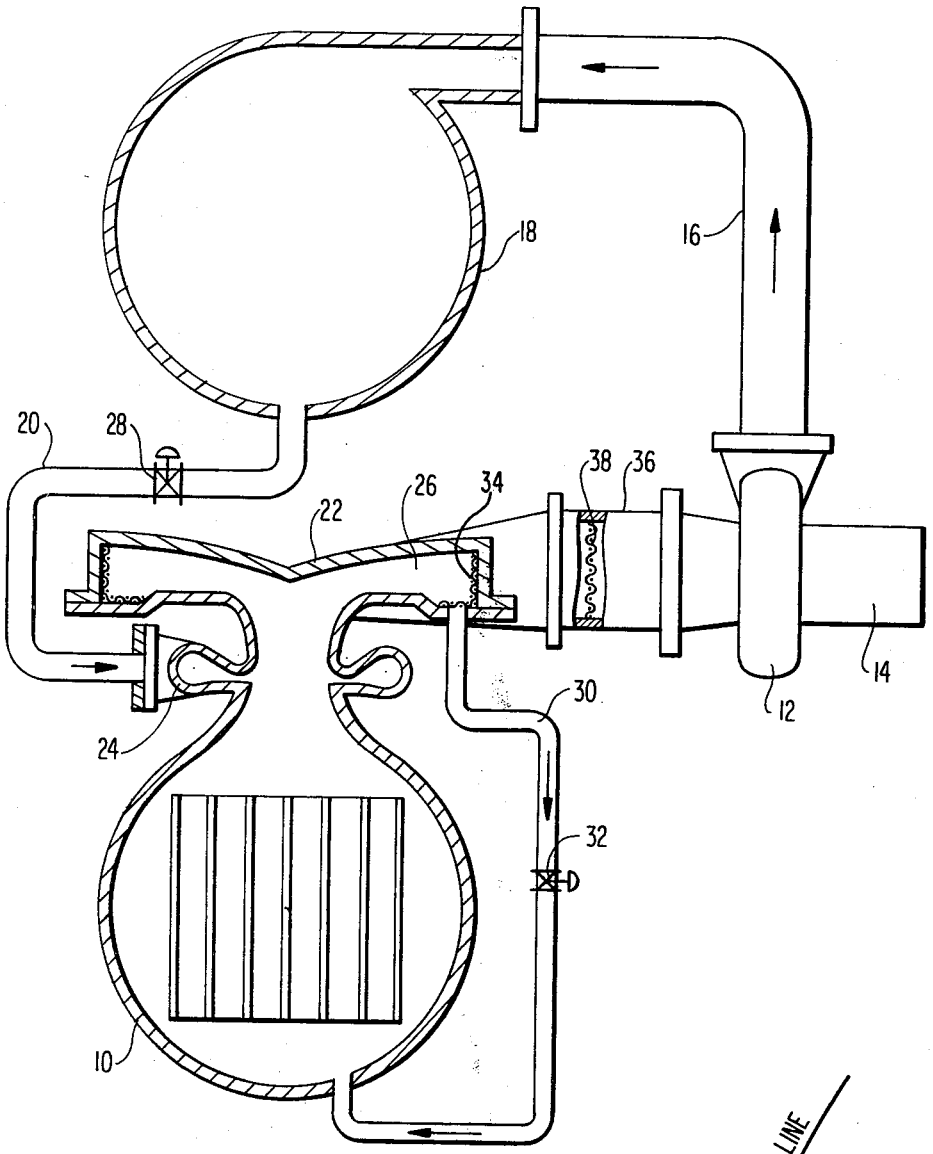
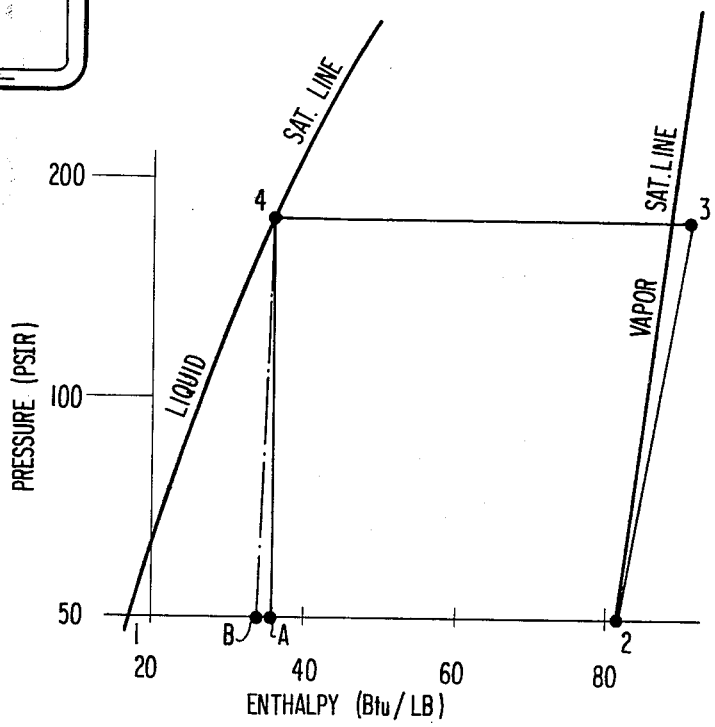
FIG 2
REFRIGERATION DIAGRAM FOR R-12

VORTEX GENERATOR FOR SEPARATING A GASEOUS AND LIQUID REFRIGERANT

BACKGROUND OF THE INVENTION

In a conventional vapor compression cycle for use in a refrigeration or liquid chilling system, the refrigerant is compressed into a gas or vapor by the compressor and delivered to a condenser. The gas or vapor flow through the condenser where the heat of vaporization is removed, and it is changed to a liquid as it leaves the condenser, and it then expands through a throttle valve. As the refrigerant expands part of it flashes into vapor, and it enters the evaporator where the heat from flowing water or other liquid boils the refrigerant vapor. The actual operating cycle is somewhat less efficient than the theoretical cycle, partly because of pressure drop losses and partly because more power is used in compression. Furthermore, it is also well known that expanding the liquid through a throttle valve, or what is commonly referred to as an expansion valve, is an inefficient process because the available energy in the expanding liquid is not used to perform work.

SUMMARY OF THE INVENTION

The present invention is directed to a vapor compression refrigeration system having a vortex generator means at the outlet of the evaporator, wherein the evaporated vapor flowing upwardly in the evaporator and into the low pressure core of the vortex where it mixes with the incoming energizing stream of vapor and liquid coming from the condenser. The mixture of the two streams swirls outwardly to the volute chamber of the vortex generator means wherein liquid droplets are trapped by a screen and directed through a conduit to the evaporator. The vapor is directed to the compressor by means of a suitable conduit. An object of the present invention is to expand the liquid nearly isentropically or at almost constant entropy so that the cycle or system becomes more efficient, using less power for the system.

BRIEF DESCRIPTION OF THE DRAWINGS

FIG. 1 is an elevational view, partly in section, showing a compressor, condenser, evaporator and vortex compressor of the present invention; and FIG. 2 shows a pressure enthalpy diagram for a common refrigerant of the halocarbon family designated R-12.

DESCRIPTION OF THE PREFERRED EMBODIMENT

Referring to FIG. 2 there is shown a pressure enthalpy diagram for a common refrigerant of the halocarbon family, designated R-12. The ordinary refrigeration cycle corresponding to cooling refrigerant to 20° and compressing it to a condensing temperature of 120° is shown in FIG. 2. Starting at point 4, the liquid refrigerant leaves the condenser and expands through a throttle valve at constant enthalpy to point A at the lower pressure of approximately 51 psia. As it expands, part of it flashes into vapor and it enters the evaporator where heat from flowing water or other liquid boils the vapor to move from point A to point 2 on said diagram where it is completely boiled. From point 2 to point 3, the vapor is compressed at constant entropy in a compression cycle to the high pressure of 172 psia at point 3. From this point, the vapor flows through the condenser where the heat of vaporization is removed and it is changed to a liquid at point 4 on said diagram. This is the conventional theoretical vapor compression refrigeration cycle which is commonly used for air conditioning purposes in water-chilling systems. The actual operating cycle is somewhat less efficient than the theoretical cycle shown, partly because of pressure drop losses and partly because the compressor does not compress the vapor isentropically as shown in said Figure, but more power is used in compression. It is also well known that expanding the liquid through a throttle valve, or what is commonly called an expansion valve, from point 4 to point A is an inefficient process because the available energy in the expanding liquid is not used to perform work.

There is shown in FIG. 1 a means for approaching a more nearly ideal cycle that is illustrated in FIG. 2 as 4, B, 3 and 4. A typical refrigeration cycle or system with the addition of a vortex compressor is illustrated in FIG. 1 which serves to work on the vapor by using the expansion energy in the liquid expanding from point 4 to point B to compress or partially compress the vapor on path 2 to 3. There is shown in FIG. 1 an evaporator 10 from which a vapor flows upward and eventually into a compressor 12 that is driven by a motor 14. The vapor is compressed and directed into a conduit 16 from where it is discharged into a condenser 18. In the conventional manner the vapor is condensed into a liquid that flows through the conduit 20 back to the evaporator 10 where it is recirculated and then delivered to the compressor 12.

The evaporator 10 has associated therewith a vortex compressor 22 which is located downstream from both the condenser 18 and evaporator and which vortex compresser has a lower portion or chamber 24 which is in communication with an upper part or chamber 26 of said vortex compressor.

The refrigerant flowing from the condenser as a liquid by way of the conduit 20 passes through a valve 28 that is actually at the inlet to the lower portion or chamber 24 of the vortex compressor. The valve 28 should preferably in the shape of a variable nozzle so that the pressure drop through the nozzle would be converted to kinetic energy with the mixture of vapor and liquid entering the outer part of the chamber 24 tangentially at a high velocity. As the flow of the mixture spirals into the center of the vortex, the pressure drops furthers and the tangential velocity increases but the pressure at the center must be very close to that directly above the evaporator. The lower portion 24 of the vortex compressor acts as a free vortex for the liquid flowing through the valve 28 and entering said lower portion which causes the entering liquid to flash and mix with the vapor so as to swirl in the lower chamber 24 of the vortex compressor. As the liquid and vapor flow into the lower chamber 24 of the vortex compressor, the pressure is reduced at the core of the vortex flow in the lower chamber area 24 and in the core area at the bottom of the lower portion 24 of the vortex. The lower chamber 24 is connected to the evaporator 10 so that the evaporated vapor flows up into the low pressure core of the vortex, where it mixes with the incoming energizing stream of vapor and liquid coming from the condenser through line 20 and valve 28.

The vortex so generated then carries the vapor and liquid mixture up to the upper part or chamber 26 of the vortex compressor where the vortex expands and flows outwardly toward the outer part of the vortex compressor. The vortex flows upwardly in a spiral path while the pressure increases and the velocity decreases, thereby compressing the vapor mixture and sending same towards the suction of the motor driven compressor 12. Thus, the vortex compressor utilizes the energy in the vortex generated by the incoming liquid flashing into vapor to compress the vapor coming up out of the evaporator 10 so that the vortex compressor is able to discharge the vapor to the inlet of the motor driven compressor 12 at a higher pressure than it would otherwise be possible if the motor compressor 12 attempted to suck or withdrawn the vapor directly out of the evaporator. This, therefore, acts as a means to obtain useful work out of the expanding liquid and tends to approach the cycle 4, B, 2, 3, 4 as shown in FIG. 2. This arrangement improves the cycle efficiency of the refrigeration cycle.

It is recognized that one of the problems with the vortex compressor is that the liquid refrigerant is thrown to the outer part of the vortex and would normally flow directly into the motor compressor 12. Inasmuch as this is not desirable, a conduit 30 is interposed between the outer part of the upper portion or chamber 26 of the vortex compressor and the evaporator 10. Said conduit 30 is provided with a valve 32. In order to separate the liquid from the vapor, a screen 34 is provided in the chamber or the upper part 26 of the vortex compressor so that the vortex throws the liquid outwardly against the screen which traps the liquid particles so that they are directed into the conduit 30 from whence they are discharged into the bottom of the evaporator. The mixture of the vapor flowing up from the evaporator and the incoming stream of vapor and liquid from the condenser through the nozzle valve 28 flow outward to the volute chamber 26 and the liquid droplets go through the screen at the outer wall, because they are denser than the vapor carrying them. The vapor mixture is also compressed slightly so that it leaves the volute chamber through line 36 at a higher pressure than in the core at 22. This arrangement separates practically all of the liquid from the vapor by centrifugal force much in the manner of a conventional centrifugal separator. In addition, the section of pipe or conduit 36 connecting the vortex compressor 22 and the motor driven compressor 12 may be provided with a further screen member 38 as a final separating element between the liquid and the vapor flowing into the motor compressor. The liquid so separated by the screen element 38 could be directed to the evaporator 10 by a suitable conduit not shown.

The valve 28 would normally be placed directly at the inlet of the vortex chamber, and same would normally be controlled so as to maintain liquid above the valve by an ordinary float control, not shown, and said valve would preferably be arranged so that there would be a minimum of losses and a maximum of conversion of pressure energy into kinetic energy. The valve 32 draining liquid from the vortex compressor to the evaporator can also be a level controlled valve so as to simply maintain liquid above the valve and not allow vapor to pass through same into the evaporator.

Although the foregoing description is necessarily of a detailed character, in order that the invention may be completely set forth, it is to be understood that the specific terminology is not intended to be restrictive or confining, and that various rearrangements of parts and modifications of detail may be resorted to without departing from the scope or spirit of the invention as herein claimed.

I claim:

1. In a refrigeration system embodying a compressor, condenser and evaporator connected by suitable conduits in a closed circuit, a vortex generating means for separating a gaseous and liquid refrigerant and located downstream of said evaporator, said vortex means including a lower chamber and upper chamber, said condenser connected to said lower chamber for delivering a stream of vapor and liquid thereto, said evaporator communicating with said lower chamber for delivering a stream of vapor thereto for mixing with the condenser stream of vapor and liquid, said mixture swirling outwardly into said upper chamber to separate the liquid from the vapor with said vapor flowing to said compressor with the vapor contained in the stream of vapor and liquid from said condenser by-passing said evaporator.

2. In a refrigeration system as set forth in claim 1 wherein said upper chamber is connected to said compressor by a suitable conduit for delivering vapor thereto.

3. In a refrigeration system as set forth in claim 2 wherein a liquid vapor separator is positioned in said conduit.

4. In a refrigeration system as set forth in claim 1 wherein said upper chamber is connected to said evaporator by a suitable conduit for delivering said liquid to said evaporator.

5. In a refrigeration system as set forth in claim 4 wherein a control valve is positioned in said conduit.

6. In a refrigeration system as set forth in claim 1 wherein said upper chamber is provided with a liquid separator.

7. In a refrigeration system as set forth in claim 1 wherein the conduit connecting said condenser with said lower chamber is provided with a nozzle-type valve for delivering a mixture of vapor and liquid in a tangential flow pattern to said lower chamber.

8. In a refrigeration system as set forth in claim 7 wherein said mixture spirals into the center of the vortex of the lower chamber with a pressure drop and a tangential velocity increase whereby the center of the vortex contains a mixture of the vapor and liquid from said nozzle and the vapor from said evaporator with said compressor generating a flow upwardly through the center of the vortex and into the upper chamber and subsequentially outwardly in said upper chamber with a decrease in velocity and an increase in pressure, which pressure is higher at the outer radius than at the core of the vortex.

* * * * *